US007775910B2

(12) United States Patent
Lessack

(10) Patent No.: US 7,775,910 B2
(45) Date of Patent: Aug. 17, 2010

(54) BALL GAME KIT

(76) Inventor: Robert A. Lessack, 364 North Ave., New Rochelle, NY (US) 10801

( * ) Notice: Subject to any disclaimer, the term of this patent is extended or adjusted under 35 U.S.C. 154(b) by 237 days.

(21) Appl. No.: 11/986,617

(22) Filed: Nov. 23, 2007

(65) Prior Publication Data

US 2009/0134580 A1 May 28, 2009

(51) Int. Cl.
*A63B 67/00* (2006.01)
*A63B 69/38* (2006.01)

(52) U.S. Cl. ..... 473/415; 473/465; 473/459

(58) Field of Classification Search ..... 473/415, 473/416, 465, 490; 273/317, 317.1
See application file for complete search history.

(56) References Cited

U.S. PATENT DOCUMENTS

| | | | | |
|---|---|---|---|---|
| 3,393,913 | A | 7/1968 | Safina | 273/118 R |
| 3,968,968 | A * | 7/1976 | Peterson | 473/473 |
| 3,985,359 | A * | 10/1976 | Moore | 473/473 |
| 4,355,813 | A | 10/1982 | Rathjen | 473/473 |
| 4,682,692 | A | 7/1987 | Kessler | 206/459.5 |
| 4,757,996 | A | 7/1988 | McNutt et al. | 473/526 |
| 4,834,392 | A | 5/1989 | Nixon | 473/473 |
| 4,844,478 | A * | 7/1989 | Kessler | 473/474 |
| 4,880,243 | A | 11/1989 | Raub | 473/490 |
| 5,125,669 | A | 6/1992 | Kanda | 273/348 |
| 5,692,980 | A | 12/1997 | Trotman | 473/473 |
| 5,741,194 | A * | 4/1998 | Simunek | 473/490 |
| 6,669,583 | B1 * | 12/2003 | Deppen | 473/474 |
| 6,910,978 | B2 | 6/2005 | Cooper | 473/528 |
| 7,192,030 | B1 | 3/2007 | Murphy | 273/317 |
| 2005/0079933 | A1 * | 4/2005 | Gagne | 473/446 |
| 2007/0049425 | A1 | 3/2007 | Butler | 473/415 |
| 2009/0134580 | A1 * | 5/2009 | Lessack | 273/317.4 |

FOREIGN PATENT DOCUMENTS

| | | |
|---|---|---|
| GB | 2082923 | 8/1982 |

* cited by examiner

*Primary Examiner*—Mitra Aryanpour
(74) *Attorney, Agent, or Firm*—Ernest D Buff & Associates, LLC; Ernest D. Buff; Margaret A. La Croix

(57) ABSTRACT

A ball game kit is easily carried and readily assembled to facilitate play in recreational areas such as parks or beaches. The kit includes a container housing paddles, balls, and a unilateral court assembly appointed to be laid on a ground surface and secured thereto by way of securing mechanism to yield a playing field. The playing field is divided into two opposing player courts separated by a middle zone or dead zone. The court assembly includes a continuous rope or cord-like member. The court can be readily and accurately adjusted from a singles playing court to a doubles playing court by condensing and/or expanding the court assembly, without having to add sections or dismantle the court assembly. Glow in the dark properties may be provided to the court assembly, paddles, and/or balls for play in dimly lit or foggy conditions.

14 Claims, 5 Drawing Sheets

BALL GAME KIT

BACKGROUND OF THE INVENTION

1. Field of the Invention

The present invention relates to a ball game kit for providing game play on a surface; and more particularly to a ball game kit having a rope/cable court assembly and a plurality of light-weight, portable, items needed to play a tennis-like game on a beach, or on a grassy area, that can easily be carried and set-up with minimal effort.

2. Description of the Prior Art

Recreational sport activities are frequently played at parks, beaches, or other outside areas. However, areas remote from one's home or playground, can present an environment that creates complexities for game play, especially when a plethora of equipment is needed, as well as a playing court. Currently, games played on the beach either sizeable equipment. For example, with volley ball a substantially sized net, poles and stabilizing stakes must be securely erected in the sand. Other games played on the beach involve simple activities such as catch or Frisbee. Drawing lines in the sand and utilizing makeshift devices are required for other game playing.

Various playing field or court assembly apparatuses have been provided appointed for set-up in recreational areas, however these apparatuses fail to provide a gaming kit and only include a court assembly. Moreover, the court assemblies disclosed fail to provide a game playing court that can be readily adjusted by simply folding or unfolding a unilateral court assembly. For example, U.S. Pat. No. 3,393,913 to Safina discloses a game apparatus having upstanding goal posts positioned at four corners to secure boundary strips and upstanding center posts for securing a center strip, wherein the playing field width may be increased or decreased but adjustment requires removing the goal posts from the ground and re-snapping the goal line strip at the desired width; U.S. Pat. No. 4,355,813 to Rathjen discloses a playing field layout for playing a game such as a "Frisbee" including a rectangular field divided by a skip court made of hardened material for bouncing an object, and wherein the field may be divided lengthwise by a center line to yield two smaller and equal sub-areas for four players but cannot be readily expanded in width; U.S. Pat. No. 4,880,243 to Raub discloses a portable playing court demarcation apparatus comprising a flexible outer boundary demarcation element; U.S. Pat. No. 7,192,030 to Murphy discloses a game of throw and catch providing a playing field having first and second scoring areas and out-of-bounds areas; and U.S. Patent Application Publication No. 2007/0049425 to Butler discloses a Four Square and Volleyball game played with a 3D playing field. These game apparatuses are merely court assemblies, and are not gaming kits that provide requisite game play equipment along with the court assembly. Moreover, none of these court assemblies provide the ability to simply expand/condense the width of the field to readily yield a doubles/singles court, via fold lines.

Conversely, other gaming apparatuses fail to provide a court assembly, and only provide discrete items for game play. For example, U.S. Pat. No. 6,910,978 to Cooper discloses a game racket; and U.S. Pat. No. 4,682,692 to Kessler discloses a carry-all with indicia mounting means. These gaming apparatuses are merely appointed to be utilized in conjunction with other equipment, and do not provide game playing kits with a court assembly and playing equipment.

Even where game playing kits have been provided, these kits fail to provide a kit appointed with a plurality of gaming equipment and a unilateral playing court assembly having fold lines for ready adjustment from a singles to a doubles court, and vise versa, in an accurate effortless manner requiring no measuring or calibration. For example: U.S. Pat. No. 3,968,968 to Peterson discloses a game apparatus for the playing of mini-volleyball by two players disposed in a sitting or kneeling position, including a ball and corner weights having a flexible cord extending therebetween and defining a rectangular playing court divided in half by a detachable height adjusting net; U.S. Pat. No. 4,757,996 to McNutt, et al. discloses a two-handed paddle ball game, and a paddle for playing the game, wherein two separate court entities are formed from stretching cords around pegs, and wherein the two separate courts must be spaced apart a given area to form a dead zone; U.S. Pat. No. 4,834,392 to Nixon discloses a court game apparatus, game method and playing court including a small resilient ball, at least two paddles having a solid, substantially rigid striking surface, and a playing court divided into two opposing playing zones of equal size; U.S. Pat. No. 4,844,478 to Kessler discloses a kit for a racket game including a plurality of rubber balloons which can be inflated with water, a net and posts and a plurality of special rackets and a carrier, as well as at least one ball; U.S. Pat. No. 5,125,669 to Kanda discloses a transportable playing court, having non-ball-confining boundaries; U.S. Pat. No. 5,692,980 to Trotman discloses a kick bag game and apparatus kit for playing providing opposing teams divided into two zones by a medially positioned portable reticulated net; U.S. Pat. No. 6,669,583 to Deppen discloses a paddle ball game including at least two hitting devices, a resilient projectile and at least two eight foot squares spaced twelve feet apart; and Foreign Publication No. GB2082923 to Zimm discloses a kit for playing games of the type in which a missile is projected across a net or space, providing a set of colored discs for defining zones together with a pair of bats and a missile.

None of these gaming kits provide a kit appointed with a plurality of gaming equipment and a unilateral playing court assembly having fold lines for ready adjustment from a singles to a doubles court. Several of these gaming kit's court assemblies provide courts that can only form game play for two to four players by dividing the game court, not by increasing the game court's width so that each player is to remain in their respective box or otherwise trip over the court line divide while playing. Others provide separate play courts set-up as two distinct play areas placed separate from one another to form a zone therebetween rather than providing a unilateral court assembly. As a result, the two separate courts must be set-up and measuring required to ensure a proper or constant distance is spaced between the separate courts.

Notwithstanding the efforts of prior art workers to construct game kits for set-up and play in recreational areas, there remains a need in the art for a ball game kit that includes a plurality of gaming equipment, pieces, and a court assembly disposed in a carrying bag or container. In addition, there exists an art recognized need for a ball game kit that includes a unilateral playing court assembly that can readily be placed on a surface and secured thereto to yield a game playing court and a dead zone. Moreover, there is a need in the art for a ball game kit having a unilateral playing court assembly having fold lines integrated therein for ready adjustment in width from a singles to a doubles court.

SUMMARY OF THE INVENTION

The present invention provides a game kit, or ball game kit that includes a plurality of gaming equipment, pieces, and a court assembly disposed in a carrying bag or container. The ball game kit includes a unilateral playing court assembly that can readily be placed on a surface and secured thereto to yield a game playing court divided by a dead zone. The players can accurately and confidently set-up the unilateral playing court assembly by unfolding the court, stretching it out and securing it with securing means, such as stakes, without performing measurements for court size or dead zone area accuracy. Fold lines are integrated within the construct of the court assembly to provide the ability to readily adjust the court's width from a singles court to a double court, and vise versa, without having to add sections or dismantle the court assembly. For example, when a doubles court is required, the players simply undo the securing means located on the sides of the court and unfold the court assembly on the fold lines, expand the court to the doubles width and replace the securing means to the sides of the court at the new width location. Advantageously, the ball game kit provides a neat, organized kit which includes sporting items/equipment and a unilateral ready-adjustable court assembly needed to play a tennis-like game on the beach, or on a grassy area, that can easily be carried to a location and set-up with minimal effort.

The ball game kit comprises a kit container that is portable in nature, a plurality of paddles, a plurality of balls having varying weights and a unilateral court assembly appointed to be laid on a ground surface and secured thereto by way of securing means to yield a playing field. The playing field of the unilateral court assembly is divided into two opposing player courts separated by a middle zone or dead zone demarcated by a divide line. The court assembly is comprised of a rope or cord-like member and constructed having an outer perimeter, dual lengthwise fold lines, and dual widthwise fold lines. The dual lengthwise fold lines are appointed to be condensed or folded to form a singles playing court and expanded to form a doubles playing court. The court assembly can be readily and accurately adjusted from the singles playing court to the doubles playing court (and vise versa) by condensing and/or expanding, respectively, the court assembly, without having to add sections or dismantle the court assembly.

BRIEF DESCRIPTION OF THE DRAWINGS

The invention will be more fully understood and further advantages will become apparent when reference is had to the following detailed description of the preferred embodiments of the invention and the accompanying drawings, in which.

DETAILED DESCRIPTION OF THE INVENTION

A ball game kit for providing ready game play on a surface in a recreational area, such as a beach or park, is provided by the present invention. All requisite play equipment and a court assembly are provided within a carrying bag or container, including a plurality of paddles, balls and a court assembly. The court assembly of the ball game kit is constructed as a unilateral playing court assembly composed of a cord or rope like structure that is lightweight in nature and can readily be placed on a surface and secured thereto to yield a game playing court with a dead zone centrally located between two player fields/zones. Fold lines are integrated within the construct of the court assembly to provide the ability to readily adjust the court's width from a singles court to a double court, and vise versa, without having to add sections or dismantle the court assembly.

Figure 1:
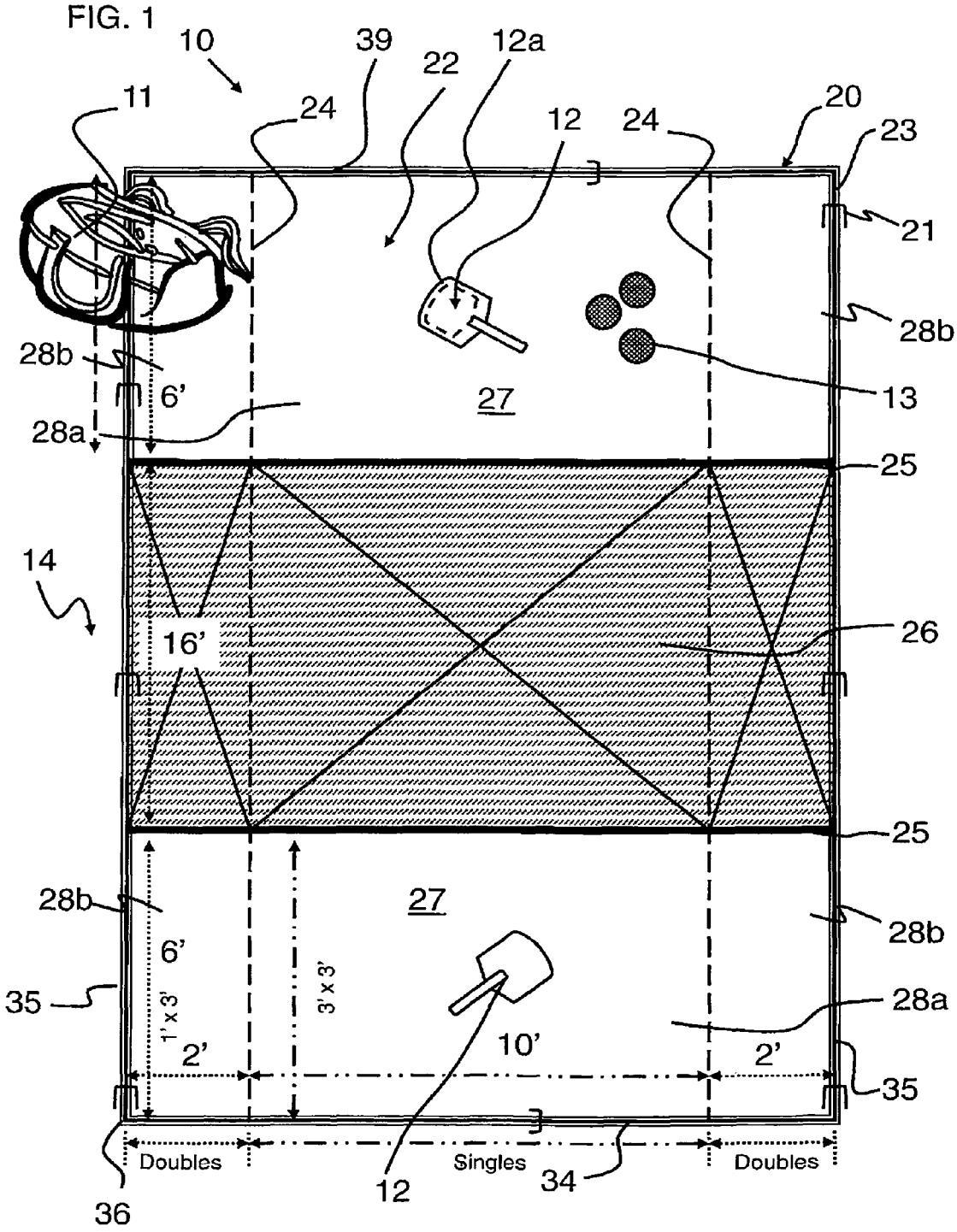
FIG. 1 illustrates a top schematic view of an embodiment of the ball game kit assembled on the ground.
Figure 4A:
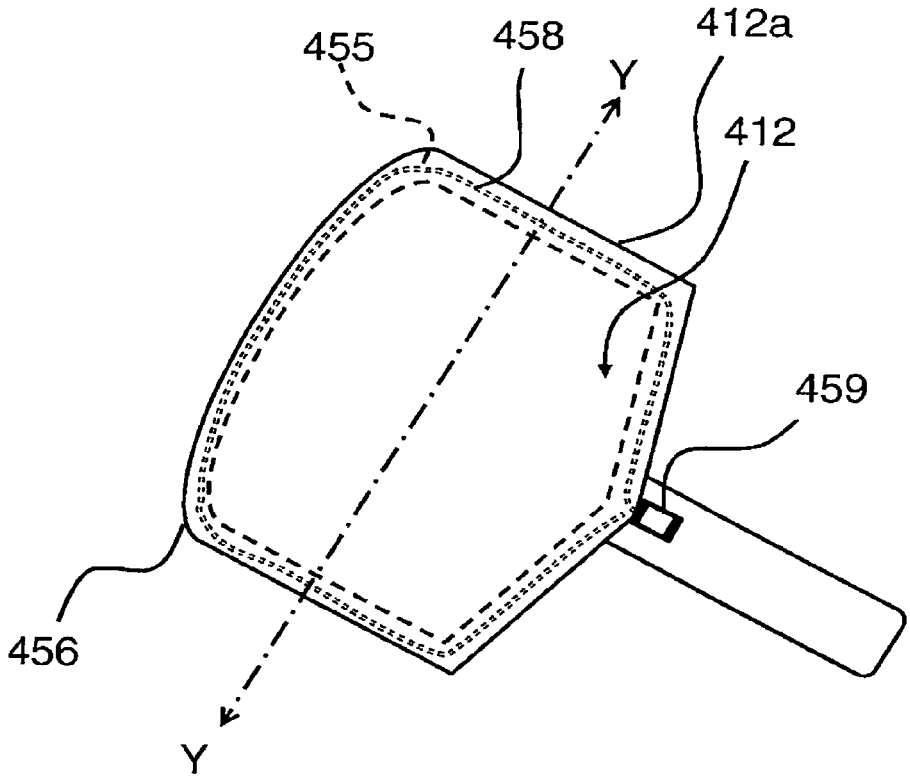
FIG. 4*a* illustrates a top view of a paddle provided with an electroluminescent light source constructed therein as shown in FIG. 1.
Figure 4B:
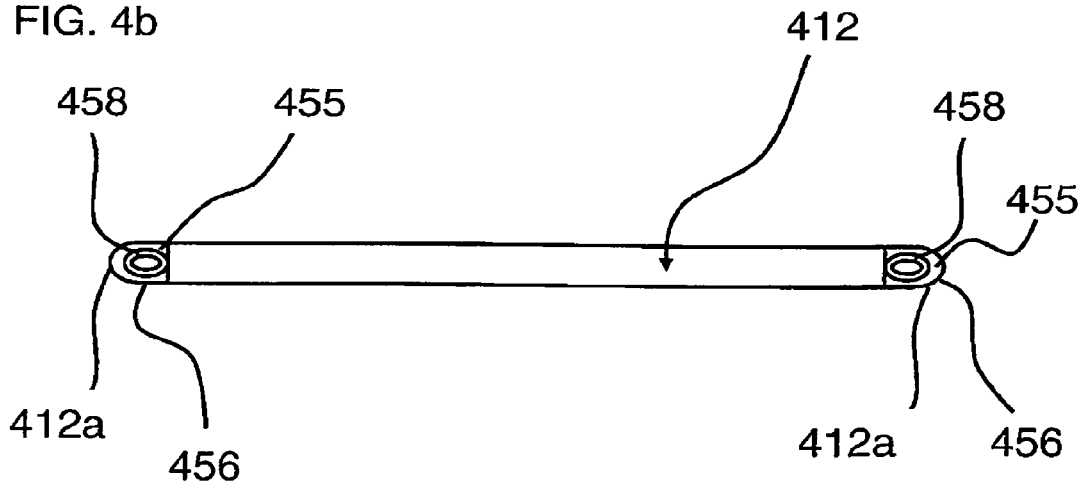
FIG. 4*b* illustrates a cross-sectional view of the paddle of FIG. 4*a* taken along line Y-Y.

FIG. 1 illustrates an aerial view of the Ball Game Kit 10 assembled on the ground. Ball Game Kit 10 includes a kit container 11, herein shown as a bag, being portable in nature, housing a plurality of paddles 12. Kit container 11 is portable in nature, and is constructed of a durable light weight material. Paddles 12 are of different sizes, weights and materials and are manufactured from wood, plastics and rubber coatings, each having different characteristics. Paddles 12 may be provided as a plurality of skill-level paddle sets for different game play levels, including novice, intermediate and professional which provide guidelines for the construction of paddle 12. At least four paddles are provided in each skill-level paddle set so that players of the same skill set can play a game appointed for four player double court game play. "Professional" skill-level paddles 12 must be constructed according to strict guidelines as to surface treatment and dimensions of the striking surface. Paddles 12 may include a glow in the dark surface for night play. The glow in the dark surface may be provided via a phosphorous material adhered to the striking surface or rim 12*a* around the striking surface. Alternatively, reflective material may be adhered to the paddle to provide reflective visibility. In another embodiment, as shown in FIG. 1 and in more detail in FIG. 4*a* (showing an enlarged view of the paddle) and 4*b* (showing a cross-sectional view taken along Y-Y of FIG. 4*a*), paddles 12, 412 may be provided with an electroluminescent light source constructed within the paddles, particularly rim 12*a*, 412*a* preferably includes a hollow core 455 and transparent lip or shell 456 that circumferentially encircles a substantial portion of rim 12*a*, 412*a* to provide an internal groove or area at within the hollow core 455 appointed for housing an electroluminescent strip/cord 458 powered by current controlled by an on/off switch 459 located near the handle of the paddle powered by a battery, or controlled by a light sensor located on the rim 12*a*, 412*a* powered by a battery.

A plurality of balls 13 is provided. Like paddles 12, varying skill-level ball sets are preferably provided for the different game play levels, novice, intermediate and professional. These varying balls 13 connote the different game play levels by varying in weight, color and like characteristics. Preferably, balls 13 are coated with or have integrated therewith a glow-in-the-dark substance for night play, and include color coated or demarcation features so that the different play level paddles or balls can be readily discerned. The glow in the dark surface of ball 13 may be provided via a phosphorous material adhered to the surface. Alternatively, a reflective strip may be adhered to ball 13 to provide reflective visibility. The utilization of the glowing properties of ball 13 and paddle 12 provides the ability to play the game during dusk or dimly lit conditions, or during foggy or misty conditions, while at the same time providing safety to the players and others in proximity of the game. Optionally, a coin or other deciding device may be included in the kit along with a rule book and a player score keeping book or journal.

A unilateral court assembly 20 is provided within container 11 and is appointed to be laid on ground 14 and secured into place by way of securing means 21 to define a playing field 22. Court assembly 20 is comprised of a rope, cord, tube or strip that is contiguous to form the desired play areas and dead zone, thus yielding a unilateral court assembly 20. In this manner, when placing the court assembly 20, no measuring is needed, the player courts and dead zone are already accurately and predetermined in size, shape and distance, thereby allowing the court assembly 20 to simply be unfolded from the kit, laid out upon the ground, and secured thereto. Court assembly 20 includes an outer perimeter 23, dual lengthwise fold lines 24, and dual widthwise fold lines 25. Court assembly 20 includes an outer perimeter 23 having a first boundary 34, second boundary 39 opposite first boundary 34, and lateral edges 35 connecting first boundary 34 and the second boundary 39 at corner-joint 36. Securing means 21 may be of any type of stake or weight. As shown herein, inverted u-shaped stakes are provided and dispersed along the perimeter of court assembly 20. Dual widthwise fold lines 25 act as net dividers and form a middle zone or dead zone 26, herein shown shaded, and create opposing player sides on field 22. Along with the dual widthwise fold lines 25 the dual lengthwise fold lines 24 form opposing player zones or courts 27, which are each provided as singles zone 28*a* or via increased width size to provide doubles zone 28*b*. When fully extended, field 22 includes the doubles zone 28*b* so that two players can make a team to play two other players (or conversely, singles zones 28*a* so that single players can play against one another). Preferably, singles zone 28*a* of player zones or courts 27 has a width ranging from 8 feet to 12 feet, and is most preferably 10 feet in width, as indicated. Correspondingly, when singles zone 28*a* is set at its desired width, dead zone 26 width is set to same. Doubles zone 28*b* of player zones or courts 27 preferably has a width ranging from 12 feet to 18 feet, and is most preferably 14 feet in width. As such, dual lengthwise fold lines 24 extend singles court 28*a* by preferably 2 feet on each left and right sides of singles court 28*a* to yield a preferable 14 feet doubles court 28*b*. Correspondingly, when doubles zone 28*b* is set at its desired width, dead zone 26 width is set to same. The length of field 22 is not adjusted when setting field 22 down to form the playing filed/courts (singles 28*a*/doubles 28*b*), and preferably field 22 has a length preferably ranging from 10 feet to 42 feet based on the preferred ranges of each of courts 27 and dead zone 26. Specifically, preferably singles court 28*a* and doubles court 28*b* have a length ranging from 5 feet to 10 feet, and most preferably is 6 feet in length, as indicated. Moreover, dead zone 26 has a preferred length ranging from 12 feet to 22 feet, and is most preferably 16 feet, separating courts 27, as indicated.

Figure 2A:
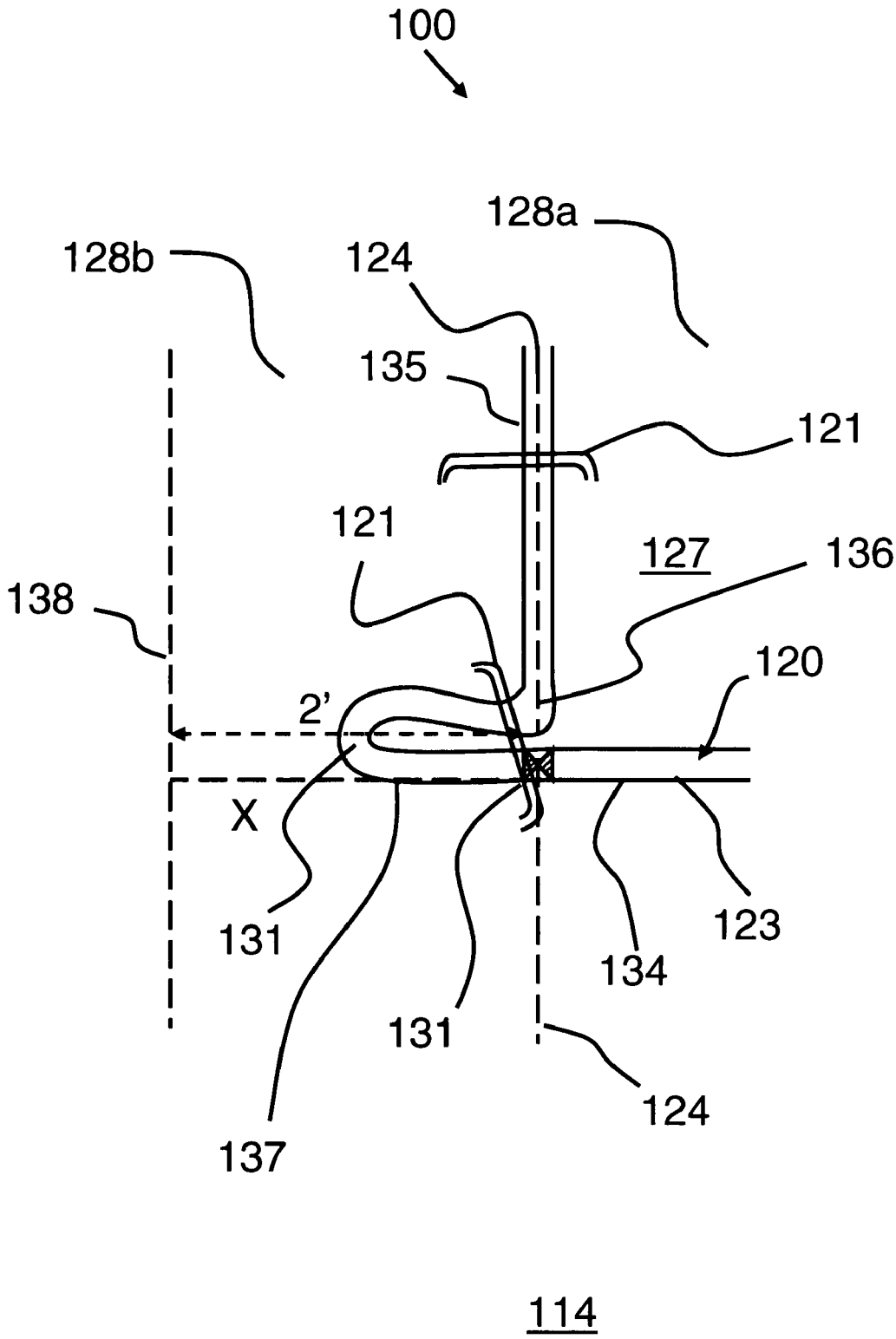
FIG. 2*a* illustrates a side planer partial view of a corner section of the court assembly, showing the court folded to form a singles court.

FIG. 2*a* illustrates a side planer partial view of a corner section of the court assembly, showing one corner folded to form a singles court, shown generally at 100. Court assembly 120 may be comprised of polypropylene rope knotted or welded, which when laid on the ground and tacked or secured in place with pins, via securing means 121, forms the playing court. Alternatively, court assembly 120 may be composed of a cord, tubing or ribbon. Unilateral court assembly 120 is appointed to be laid on ground 114, such as a beach or lawn, and secured into place by way of securing means 121. Court assembly 120 is comprised of a rope, cord, tube or strip that is contiguous to form the desired play areas and dead zone, thus yielding a unilateral court assembly 120. Court assembly 120 includes an outer perimeter 123 having a first boundary 134 (shown), second boundary (not shown) opposite first boundary 134, and lateral edges 135 (part of which is shown) connecting first boundary 134 and the second boundary at corner-joint 136. Dual lengthwise fold lines 124 are demarcated and located on first boundary 134 (and the opposing second boundary on the other side of the play field) with a mid-fold point 131 to provide a doubles court extension 137 that is folded at mid-fold point 131 so that extension 137 folds upon first boundary 134 and lateral edge 135 lies parallel with lengthwise fold line 124 to yield singles court 128*a*. Dual lengthwise fold lines 124 form opposing player zones or courts 127, which are herein provided as singles zone 128*a*. To increase the width size by X, extension 137 and visa vie lateral edge 135 are simply unfolded at point 131 and extended and secured at 138 to form doubles court 128*b*. Although only one corner 136 is shown (out of the total of four corners) the same action of folding/unfolding is performed at each of the four corners.

Figure 2B:
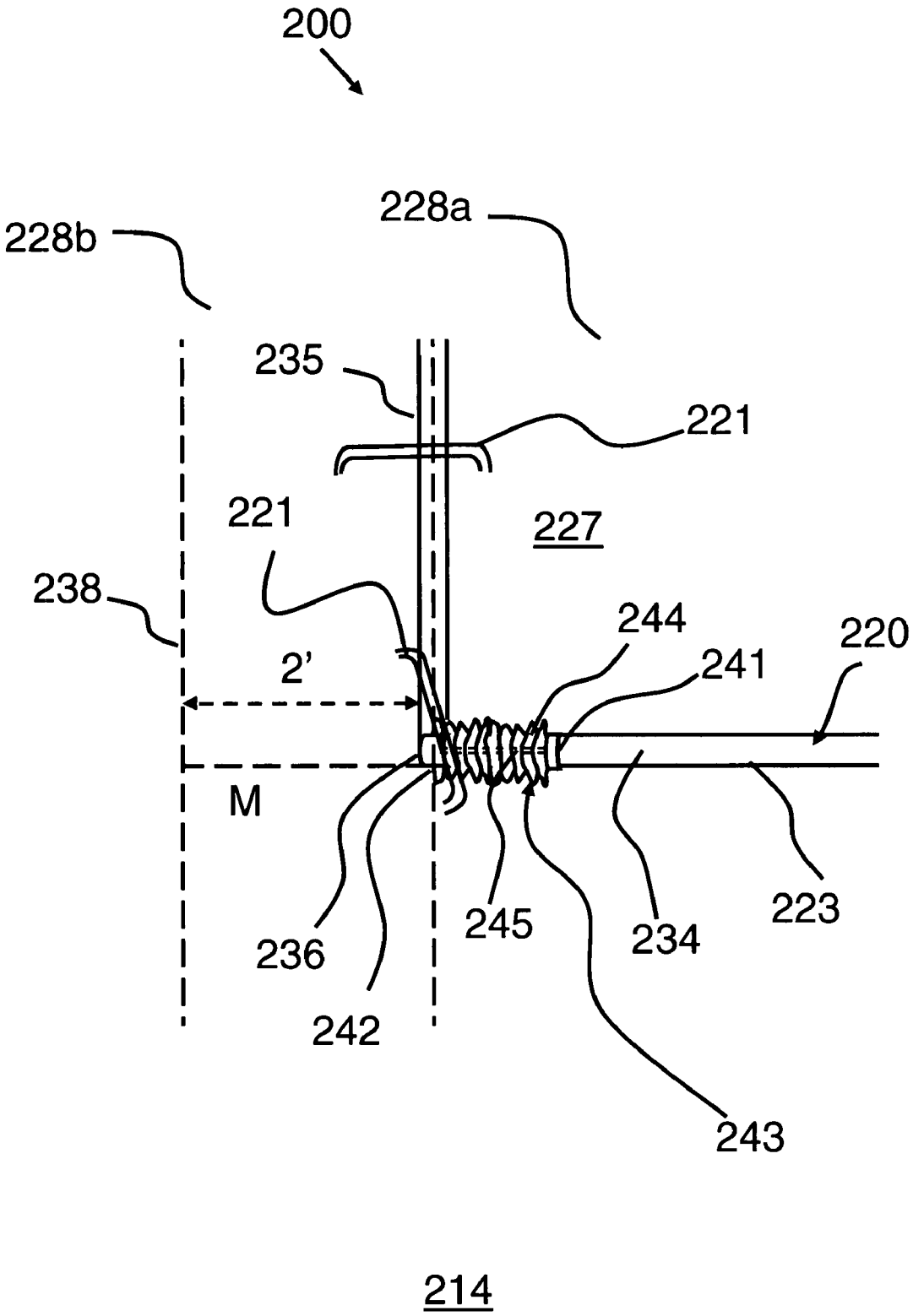
FIG. 2*b* illustrates a side planer partial view of a corner section of the court assembly, showing the court scrunched/condensed to form a singles court.

FIG. 2*b* illustrates a side planer partial view of a corner section of the court assembly, showing the court scrunched/condensed to form a singles court, shown generally at 200. Court assembly 220 may be comprised of polypropylene rope knotted or welded, cord, tubing or ribbon, which when placed on the ground and tacked or secured in place with pins, via securing means 221, forms the playing court. Court assembly 220 includes an outer perimeter 223 having a first boundary 234 (shown), second boundary (not shown—located on the other side of the court 220) opposite first boundary 234, and lateral edges 235 (part of which is shown) connecting first boundary 234 and the second boundary at corner-joint 236. In this embodiment, first boundary 234 comprises a primary bracket 241 and a secondary bracket 242 located in association with corner-joint 236 with a condensable section 243 traversing therebetween In this embodiment, the dual lengthwise fold lines are essentially determined by way of condensable section 243, as condensable section 243 is composed of flexible or gathering outer material 244 and a central elastic core 245 so that elastic core 245 is condensed and outer material 244 is gathered or scrunched when singles court 228*a* is formed as lateral edge 235 lies parallel with lengthwise fold line. Conversely, when doubles court 228*b* is to be formed, condensable section 243 is expanded by pulling on secondary bracket 242 and stretching central elastic core 245 along M so that outer material 244 becomes taunt and lateral edge 235 lies parallel with doubles line 238, and securing corner 236 with a securing means 221. Although only one corner 236 is shown (out of the total of four corners) the same action of condensing/expanding is performed at each of the four corners.

Figure 3A:
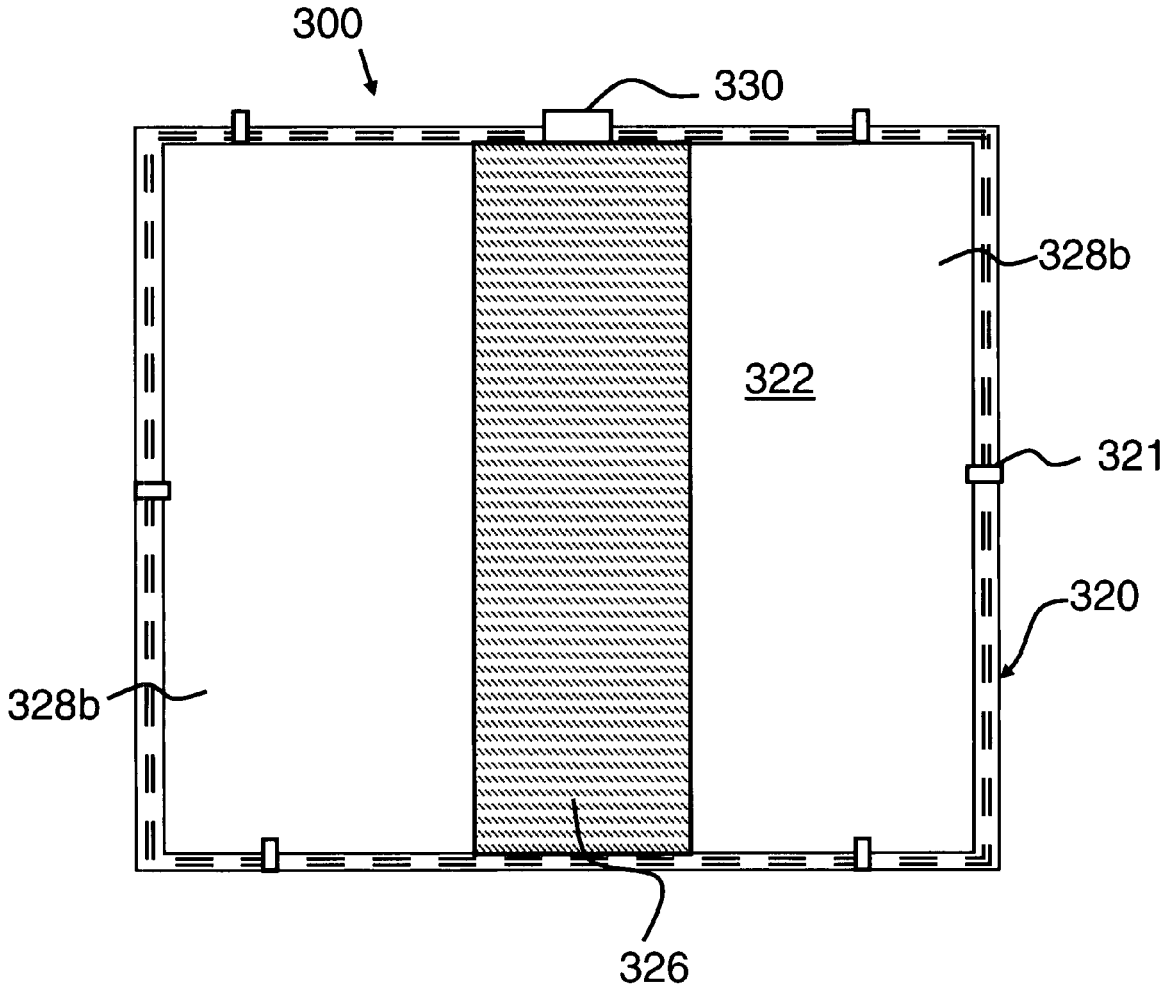
FIG. 3*a* illustrates a top aerial view of an embodiment of the unilateral court assembly wherein the court includes electroluminescent lighting.
Figure 3B:
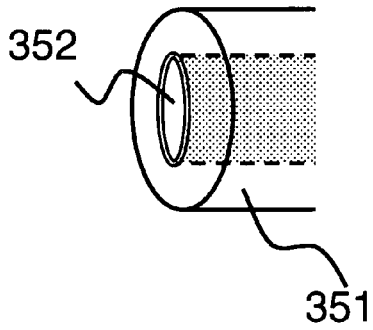
FIG. 3*b* illustrates a cross-sectional view of an embodiment of the assembly—wherein a transparent cord having an electroluminescent lighting core is utilized in the—unilateral court assembly of FIG. 3*a;*
Figure 3C:
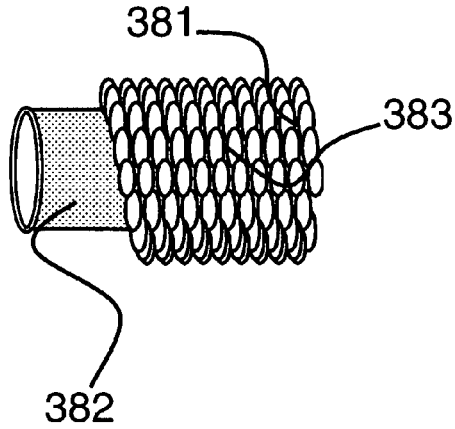
FIG. 3*c* illustrates a cross-sectional view of an embodiment of the assembly wherein a rope having transparent cable is wound around an electroluminescent lighting core is utilized in the unilateral court assembly of FIG. 3*a*.

FIGS. 3*a*-3*c* show embodiments of the court assembly wherein the court assembly includes electroluminescent lighting. FIG. 3*a* illustrates a top aerial view of an embodiment of the unilateral court assembly wherein the court includes electroluminescent lighting, shown at 300. Court assembly 320 may be comprised of polypropylene rope as shown in FIG. 3*c*, which when laid on the ground and tacked or secured in place with pins, via securing means 321, forms playing field 322 herein shown with doubles courts 328*b* and dead zone 326. The rope or cord making up the court assembly 320 may include reflective and/or glow-in-the-dark properties, such as phosphorous bound to the fibers. Visibility of the rope of the court assembly may be imparted by incorporating light sticks, electroluminescent lighting strip or ribbon into the structure of the rope. FIG. 3*b* illustrates a cross-sectional view of an embodiment of the assembly wherein a transparent outer cord shell 351 is provided surrounding an electroluminescent lighting core 352 (via electroluminescent light strip or ribbon) so that light is transmitted from the cord. FIG. 3*c* illustrates a cross-sectional view of an embodiment of the assembly wherein a rope 381 having at least one transparent cable 383 is wound or braided around an electroluminescent lighting core 382. Power can be provided to the electroluminescent lighting core 352, 382 in the unilateral court assembly 320 via a power source (such as a battery) 330 that delivers current to electroluminescent lighting source/core 352, 382 via a power control switch (on/off) or alternatively controlled by a light sensor that causes current to become activated when a small quantum of light is received through sensors located on/in proximity to power source 330.

The rules of the game include: (1) choosing to play either doubles (so that the wider, doubles zone 28*b* is used as the playing field 22 for each side) or singles (so that: the thinner, single zone 28*a* is used as the playing field 22 for each side; (2) selecting teams or players; (3) utilizing a coin or other device, that determines which team or player serves first, such as by flipping the coin; (4) serving the ball: the server must stand anywhere behind the outside line on his or her side of the court and the ball must be served underhand and must clear the "net" or dead zone 26; (5) each player or team serves 3 or 5 times, then the other player or team serves 3 or 5 times and so on until one team reaches 11, 16 or 21 pointes as is decided prior to starting the game; and (6) once the serve is made, the players may strike the ball 13 in any fashion to return ball 13 to the opponent's side or court. The object of the game is to try to hit the ball into the opponent's open court and likewise to defend against the same. A point is made by either the serving or receiving team each time the ball 13 lands in the opposite court. A ball 13 which lands outside of the court or in the dead zone 26 is a point for the team that did "NOT" hit the ball 13. Conversely, the team which hits the ball out is penalized by the opposing team securing the point. An "ACE" occurs when the server lands his/her serve in the opponent's court with no return. For Doubles versus Singles the rules remain the same; the court is extended to the increased "doubles" size for 2 players on each side. When playing "doubles" the team serving chooses who is to serve first and then either member of the team receiving may return the ball. The serve changes after each 5 points, thereby rotating to each of the team members.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A ball game kit, comprising:

a. a kit container that is portable in nature;

b. a plurality of paddles;

c. a plurality of balls having varying weights;

d. a preassembled unilateral court assembly appointed to be laid on a ground surface and secured thereto by way of securing means to yield a playing field divided into two opposing player courts separated by a middle zone or dead zone demarcated by a divide line;

e. said court assembly being preassembled and comprised of a rope or cord-like member and constructed having an outer perimeter, dual lengthwise fold lines, and dual widthwise fold lines, wherein said dual lengthwise fold lines are appointed to be condensed or folded to form a singles playing court and expanded to form a doubles playing court;

wherein said court assembly can be readily and accurately adjusted from said singles playing court to said doubles playing court (and vise versa) by condensing or expanding, respectively, said court assembly, without having to add sections or dismantle said court assembly.

2. A ball game kit as recited by claim 1, wherein said plurality of paddles comprises a plurality of skill-level paddle sets, wherein each of said skill-level paddle sets are constructed for different game play levels, including novice, intermediate, and professional play levels, and wherein each of said different skill-level paddle set is demarcated to indicate said skiff-level.

3. A ball game kit as recited by claim 1, wherein each of said paddle is appointed to be visible in dusk or dimly lit conditions by having a glow-in-the-dark material or surface integrated with or removably attached to each of the paddles.

4. A ball game kit as recited by claim 1, wherein said paddles comprise a rim having a hollow core and a transparent lip, said hollow core being appointed with an electroluminescent light strip housed therein activated by a power source located within a handle portion of said paddle.

5. A ball game kit as recited by claim 1, wherein said plurality of balls comprises a plurality of skill-level ball sets, wherein each of said skill-level ball sets are constructed for different game play levels, including novice, intermediate, and professional play levels, and wherein each of said different skill-level ball set is demarcated to indicate said skill-level.

6. A ball game kit as recited by claim 1, wherein each of said ball is appointed to be visible in dusk or dimly lit conditions by having a glow-in-the-dark material or surface.

7. A ball game kit as recited by claim 1, wherein said unilateral court assembly comprises a rope having a fibrous surface with phosphorous bound thereto for glow-in-the-dark properties for night or evening play, or play in foggy conditions.

8. A ball game kit as recited by claim 1, wherein said unilateral court assembly comprises a rope having an outer surface with at least one transparent portion surrounding an electroluminescent lighting core, and wherein said unilateral court assembly includes a battery power supply activated by a control switch for providing current to said electroluminescent lighting core.

9. A ball game kit as recited by claim 1, wherein said unilateral court assembly comprises a polymeric cord wherein said cord has a transparent outer shell surrounding an inner electroluminescent lighting core, and wherein said unilateral court assembly includes a battery power supply activated by a control switch for providing current to said electroluminescent lighting core.

10. A ball game kit as recited by claim 1, wherein said unilateral court assembly comprises an outer perimeter having a first boundary, second boundary opposite said first boundary, and lateral edges connecting said first and second boundaries at corner-joints, and wherein said dual lengthwise fold lines are demarcated and located on said first boundary and second boundary with a mid-fold point to provide a doubles court extension that is folded at said mid-fold point so that said extension folds upon said first boundary and said lateral edge lies parallel with said lengthwise fold line to yield said singles court and said extension and visa vie said lateral edge are simply unfolded at said mid-fold point and extended and secured to form said doubles court.

11. A ball game kit as recited by claim 1, wherein said unilateral court assembly comprises an outer perimeter having a first boundary, second boundary opposite said first boundary, and lateral edges connecting said first and second boundaries at corner-joints, and wherein said first boundary comprises a primary bracket and a secondary bracket located in association with said corner-joint with a condensable section traversing therebetween so that said dual lengthwise fold lines are essentially determined by way of said condensable section, said condensable section is composed of a flexible or gathering outer material and a central elastic core so that elastic core is condensed and outer material is gathered or scrunched when said singles court is formed as said lateral edge lies parallel with said lengthwise fold line, conversely when said doubles court is to be formed said condensable section is expanded by pulling on said secondary bracket and stretching said central elastic core so that said outer material becomes taunt.

12. A ball game kit as recited by claim 1 comprising a coin device for determining play order.

13. A ball game kit as recited by claim 1 comprising a rule book containing game playing rules and a player score keeping book or journal.

14. A ball game kit as recited by claim 13, wherein said game playing rules include:

a. choosing to play either a doubles or singles game and selecting teams or players and selecting respective said paddles and balls;

b. utilizing a coin or other device to determine a team or player that serves first;

c. serving said ball by a server, wherein said server must stand anywhere behind an outside line on his or her side of said court and said ball must be served underhand and must clear said "net" or dead zone;

d. each player or team serves 3 or 5 times, then said other player or team serves 3 or 5 times and so on until one team reaches 11, 16 or 21 points as is decided prior to starting said game; and e. once said serve is made, said players may strike the ball in any fashion to return ball to opponent's side or court;

f. said game's object being to try to hit said ball into said opponent's open court and likewise to defend against same, wherein a point is made by either said serving or receiving team each time said ball lands in said opposite court, wherein said ball which lands outside of said court or in said dead zone is a point for said team that did "NOT" hit said ball, conversely, said team which hits said ball out is penalized by said opposing team; and g. said serve changes after each 5 points, thereby rotating to each of said team members.

* * * * *